US005526544A

United States Patent [19]

Wiedeck et al.

[11] Patent Number: 5,526,544

[45] Date of Patent: Jun. 18, 1996

[54] DEPLOYABLE BRIDGE

[75] Inventors: Hans N. Wiedeck, Mülheim; Wolfgang Diefendahl, Straelen, both of Germany

[73] Assignee: Krupp Fördertechnik GmbH, Duisburg, Germany

[21] Appl. No.: 297,547

[22] Filed: Aug. 31, 1994

[30] Foreign Application Priority Data

Aug. 31, 1993 [EP] European Pat. Off. ..... 93113929

[51] Int. Cl.[6] ..... E01D 15/12

[52] U.S. Cl. ..... 14/2.4; 14/13; 14/14

[58] Field of Search ..... 14/2.4, 2.5, 2.6, 14/9, 10, 11, 13, 14

[56] References Cited

U.S. PATENT DOCUMENTS

| | | | |
|---|---|---|---|
| 4,089,148 | 5/1978 | Oehmsen et al. | 52/693 |
| 5,293,658 | 3/1994 | Hüther | 14/2.4 |

FOREIGN PATENT DOCUMENTS

| | | |
|---|---|---|
| 0374019 | 6/1990 | European Pat. Off. . |
| 0391149 | 10/1990 | European Pat. Off. . |
| 0449064 | 10/1991 | European Pat. Off. . |

*Primary Examiner*—Ramon S. Britts

*Assistant Examiner*—Pamela A. O'Connor

*Attorney, Agent, or Firm*—Spencer & Frank

[57] ABSTRACT

A deployable bridge having at least one bridge section which includes a base body; and a road section articulated to the base body for pivotal movement about a horizontal pivot axis oriented transversely to the length of the base body. The road section has a first pivotal position in which the road section lies lengthwise on the base body. The road section has a second pivotal position in which the road section is in a raised state relative to its first pivotal position. There is further provided a pivot shaft mounted on the base body and having a horizontal pivot axis oriented transversely to the length of the base body. A support member adjoins the base body and is articulated to the base body by the pivot shaft. The support member has a first pivotal position in which it is in a flat-lying state. In such flat-lying state the free outer end of the support member projects beyond the outer end of the road section in a direction away from a location situated at midlength of the bridge section. The support member has a second pivotal position in which it is in a raised position relative to its first position. A coupling mechanism pivotally connects the support member to the road section such that when the road section is in its first position, the support member too, is in its first position and the outer end of the road section is supported on the support member.

27 Claims, 3 Drawing Sheets

DEPLOYABLE BRIDGE

CROSS REFERENCE TO RELATED APPLICATION

This application claims the priority of European Application No. EP 93 113 929.9 filed Aug. 31, 1993, which is incorporated herein by reference.

BACKGROUND OF THE INVENTION

This invention relates to a deployable bridge formed of at least one bridge section which includes the following parts:

A base body which decreases in height at least towards one of its ends;

At least one road section pivotal about a horizontal transverse shaft positioned at a distance from the ends of the base body for movement between a drive-on or ramp position in which the road section lies on the associated end of the base body and a coupling position in which the road section is raised relative to the ramp position; and A support articulated to the base body by a further transverse shaft.

There is further provided a vehicle for coupling two bridge sections to form a bridge of the above-outlined type and also for deploying such a bridge.

Published European Patent Application 0 374 019 discloses a bridge of the above-outlined type whose bridge section decreases in height towards both ends and is, in the middle, provided with a transverse shaft to which a pivotal road section is articulated. In the embodiment shown in FIGS. 1–19 of the European patent application the supports are in each instance articulated to the base body of the bridge and may be pivoted upwardly relative to the pivotal road section. It is a disadvantage of this construction that the supports are of unlike construction and furthermore, in the drive-on position of the bridge section they are, with their free ends, oriented towards the middle of the bridge section and thus cannot be used as ramp portions. Also, the supports of the prior art construction must be guided or lifted throughout their entire pivotal path to move the pivotal road sections into their uppermost position. The large strokes necessary for such a motion require complex and expensive hoisting devices.

According to the above-identified published European patent application it is known to deploy a bridge, formed of a single bridge section, over a narrow obstacle. The pivotal road sections lie on the associated ends of the base body. There is also disclosed the deployment of a bridge, formed of two bridge sections, across a wider obstacle. In the latter case the pivotal road sections are lifted or pivoted into an upper position and held by supports relative to the base body.

SUMMARY OF THE INVENTION

It is an object of the invention to provide improved bridge sections of a bridge of the above-outlined type such that the supports for the pivotal road sections and the associated pivotal road sections themselves may be rapidly and securely brought into the desired position without substantial labor or equipment input upon deployment of the bridge.

This object and others to become apparent as the specification progresses, are accomplished by the invention, according to which, briefly stated, in the drive-on position of the respective end of the bridge section the support is in a flat-lying state and is oriented outwardly, that is, away from the middle of the bridge section, the free end of the pivotal road section is backed up by the support and the free end of the support is arranged to project beyond the free end of the road section as viewed from the middle of the bridge section. It is noted that in case the support is a ramp wedge, the free end is the tip of the ramp wedge.

By virtue of the above-described flat-lying position of the support, the latter may serve as a ramp wedge for the initial drive-on of vehicles. Inasmuch as the road section lies on the support, the road section may be lifted together with the support as the support is pivoted upwardly. Thus, the support may be regarded as a driving member and the road section as a driven member. By virtue of the fact that the road section lies with its free end on the support, an advantageous, long lever arm is obtained, whereby the driving forces may be maintained small. The support—at least in the drive-on position—projects outwardly beyond the associated road section. Such an arrangement has the following positive effect: as soon as the supports of two facing bridge sections are at least partially lifted, pushing together the bridge sections automatically results in a further upward pivotal motion of the supports, whereby the road sections are lifted into the coupling position.

According to an advantageous additional feature of the invention, the transverse shaft of the support, particularly when in the drive-on position, is situated behind the free end of the road section, that is, it is offset from the free end in the direction of the middle of the bridge section. In such an arrangement, there is always present a "positively" effective lever arm (torque) about the transverse shaft when the pivotal road section is to be lifted by and together with the support.

In order to improve efficiency, according to a further feature of the invention, the support is, at its side oriented towards the road section, provided with a guide profile which, in a simple embodiment, may be formed of strips extending parallel to the longitudinal direction of the bridge. A follower element mounted on the road section may engage the guide profile of the support.

In order to achieve a stable position of two mutually coupled bridge sections, the supports must be slightly inclined outwardly as viewed from the middle of the bridge sections. To ensure that such a position is reliably maintained, according to a further feature of the invention, the guide profile has an abutment at the free end of the support.

To establish an unequivocally defined kinematic relationship between the support and the pivotal road section, the guide profile is preferably a guide groove and the follower element is formed as a follower pin or roller extending into the groove. By virtue of the cooperation between the guide groove and the pin or the roller, an unintentional raising of the pivotal road section is securely avoided.

To ensure that the support may be universally utilized, it is preferably formed as a ramp wedge; the guide profile is situated above the road surface or, as the case may be, above the upper side of the ramp wedge.

To ensure a satisfactory entrainment of the pivotal road section by the support, according to a further feature of the invention, the guide profile has a rising course in the middle, as viewed in the flattened condition of the support and from its free end in the direction of the transversal shaft. Advantageously, the guide profile first has a short, steep course adjoined by a course of lesser slope. Further, advantageously, the guide profile has, at its end oriented towards the transverse shaft, a portion having a generally horizontal course.

To ensure that the bridge sections are deployed without difficulty and, if needed, can be coupled to one another, according a further feature of the invention the base body has a lower chord region provided with a locking device which may be operated by a coupling (actuating) mechanism. The locking device is advantageously structured as a pin-type coupling. According to a further feature of the invention, the actuating mechanism may be actuated from the exterior.

Since the bridge sections are, between themselves, coupled to one another only when the support and road section are raised, according to a further feature of the invention, the support is joined with the coupling mechanism for the locking device by a mechanical connection in such a manner that in the unlocked state of the locking device the support is in an upwardly pivoted position.

In another preferred embodiment of the invention, at least one part of the support has at least one coupling element which makes possible at least a unilateral vertical coupling of the supports when these are in engagement with one another with their free ends or edges. In this context, by "unilateral vertical coupling" there is meant an arrangement where upon raising or upwardly pivoting one support, the other, oppositely located support is raised together therewith. With such an arrangement the lifting mechanism for the supports may be accommodated on a single bridge-laying vehicle. In the simplest case, such a unilateral vertical coupling may be effected by a carrier finger mounted on a support and extending under the other support.

According to a further advantageous feature of the invention the coupling element has, at one of the supports, a pin-like carrier element and the coupling element of the respective other support has a recess formed as a guide groove.

The coupling elements are advantageously arranged laterally on the respective supports; it is sufficient if they are provided only on one side, preferably on the inside of the support. Thus, in bridges with road track elements the coupling elements are provided at that side which is oriented towards the longitudinal vertical halving plane of the bridge section.

To ensure a reliable support of the bridge it is advantageous to position the ends of the bridge as far as possible from the edges (banks) of the obstacle. For this purpose, according to a further advantageous feature of the invention, the supports may be locked to the base body of the bridge in their flat-lying position when they function as ramp wedges. According to a preferred embodiment of the invention this is achieved by providing lateral bore holes in the support. In the flat-lying position of the support the holes are situated in the zone of motion of the pins of the locking device of the lower chords.

To ensure that the bridge sections can be prepared rapidly for coupling to form a bridge, a vehicle provided for this purpose has an actuating element formed as a coupling beam for actuating the actuating mechanism of the locking device of the lower chord of the bridge section.

In a further advantageous embodiment of the invention, on the bridge-laying vehicle a lifting device, preferably a hydraulic cylinder unit, is provided for every other support. In case of bridges in which the supports have coupling elements which maintain the supports at identical height, it is sufficient if only every other support is lifted from its flat-lying, initial position by the lifting devices, because the respective oppositely located supports are also lifted by the coupling elements.

Since, upon lifting, the supports are pivoted about an axis and thus assume an inclined position, according to a further feature of the invention, the axis of the hydraulic cylinder unit is correspondingly inclined and the supporting part of the lifting device (for example, the outer end of the piston rod of the hydraulic cylinder unit) is of convex configuration.

DESCRIPTION OF THE PREFERRED EMBODIMENTS

Figure 1:
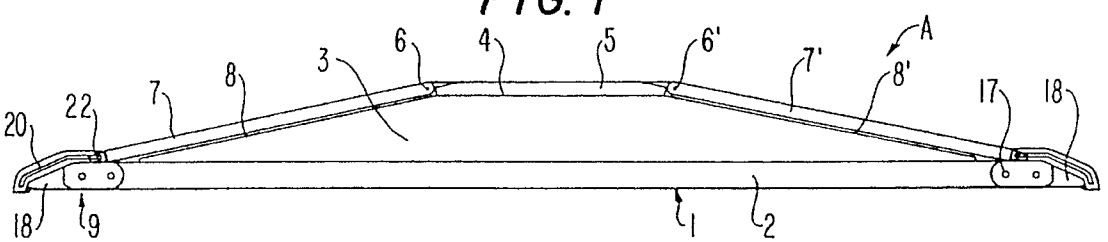
FIG. 1 is a schematic side elevational view of a bridge section constituting a short-length bridge.

Turning to FIG. 1, the bridge section generally designated at A and constituting a short length bridge has a base body 1 including a lower chord 2 and a wall element 3 oriented vertically on the lower chord 2. In the middle of the bridge section, the wall element 3 has a horizontal upper edge 4 which extends parallel to the lower chord 2. On opposite ends the upper edge 4 is adjoined by wall element edges 8, 8' sloping downwardly toward the respective opposite ends of the bridge section A. The edge 4 of the wall element 3 supports a fixed road section 5. At the transitions between the parallel part and the wedge-shaped parts of the wall element 3 horizontal transverse shafts 6, 6' are provided to which respective road sections 7, 7' are pivotally mounted. In the transporting state and when using the bridge section A as a short length bridge, the road sections 7, 7' lie on the sloping upper edges 8, 8' of the wall element 3.

Figure 2:
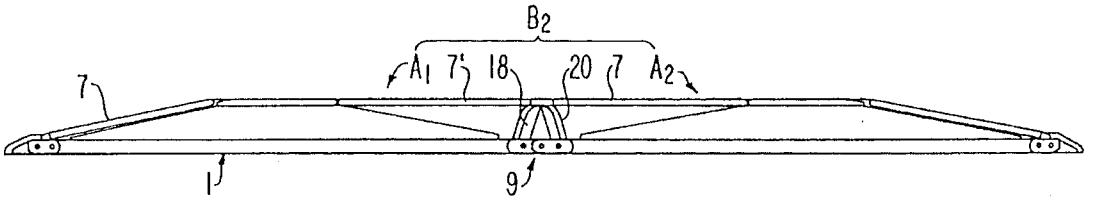
FIG. 2 is a schematic side elevational view of a deployable bridge formed of two bridge sections.
Figure 5:
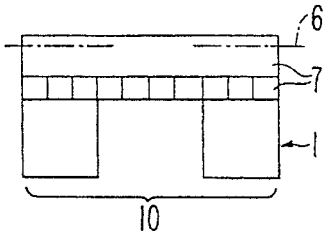
FIG. 5 is a sectional view taken along line V—V of FIG. 3.
Figure 9:
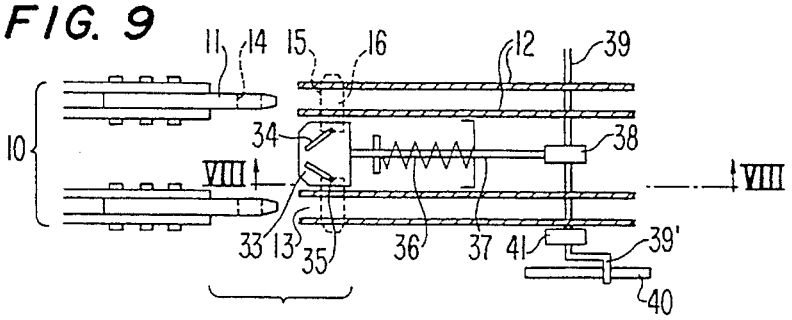
FIG. 9 is a top plan view of a lower chord coupling.

Turning to FIG. 2, for coupling together two bridge sections A1, A2, each structured in accordance with the bridge section A of FIG. 1, at the ends of the lower chord 2 coupling or locking regions 9 are provided. As shown in FIGS. 5 and 9, the bridge sections A, A1 and A2 have two lateral track elements 10 which are conventionally formed by fishplates 11 and by two receptacles 13 which are provided for the fishplates 11 and are formed by two face plates 12. The fishplates 11 as well as the face plates 12 are provided with respective bore holes 14 and 15 through which pins 16 may pass for coupling and locking together the lower chords 2 of two bridge sections A1, A2 when a bridge is formed from at least two bridge sections.

Figure 3:
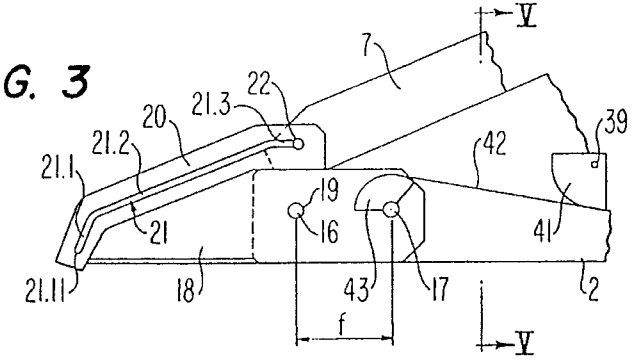
FIG. 3 is an enlarged side elevational detail of an end of the bridge section shown in FIG. 1.

Also referring to FIG. 3, at each end of the base body 1 a support member constituting a ramp wedge 18 is arranged which is pivotally mounted to the base body by a respective transverse shaft 17 affixed to the respective ramp wedge 18. The shafts 17 are rotatably supported in the lower chord 2 at a distance f from the aligned bore holes 14, 15, towards the middle of the base body 1. The length of each ramp wedge 18 is, as viewed perpendicularly to the axis of the shaft 17, greater than the distance f. In the described embodiment the length of the travellable ramp wedge 18 is approximately 3.5 times the distance f.

At the distance f from the shaft 17, in the side walls of the ramp wedges 18, bore holes 19 are provided into which the pins 16 project in the flat-lying (horizontal) position of the ramp wedges 18 for locking the latter to the base body 1.

On the upper side or road surface of each ramp wedge 18 laterally arranged guide profiles 20 are provided which have a guide groove 21 into which extend a follower pin 22 affixed to the free ends of the respective movable road sections 7 and 7'. It is to be understood that the pins 22 may be replaced by non-illustrated follower rollers projecting into the guide groove (guide track) 21. The guide groove 21 extends essentially parallel to the road surface of the ramp wedges 18. Viewing a ramp wedge 18 in its flat-lying (that is horizontal or "down") state shown in FIG. 3, the guide track 21 has, at the beginning of the wedge, first a short, steep portion 21.1 adjoined by a long portion 21.2 of lesser slope and in the zone above the coupling region 9 the guide track 21 has a short, generally horizontal length portion 21.3.

In case the ramp wedge 18 is pivoted upwardly (that is, from the flat-lying, "down" position), it moves the pin 22 and thus the road section 7 upwardly as well. To ensure that the road sections 7, 7' are lifted with the ramp wedges 18 with a possibly favorable degree of efficiency, the length of the road sections 7 and 7' is such that the free end in the lower "drive-on position" (that is, in the flat-lying position) projects beyond the shaft 17 of the respective road sections 7, 7' as viewed from the middle of the bridge section.

The end portion 21.1 of the guide track 21 has a limiting abutment 21.11 which determines, in cooperation with the follower pin 22, the steepest position of the ramp wedge 18. To such steepest position of the ramp wedge 18 corresponds the uppermost position of the road section 7 or 7' (see FIG. 4) which then extends substantially parallel to the lower chord 2. In this position, the end portion 21.1 of the guide track 21 has only a very slight rising slope so that the road section 7 is well supported even in case of large loads. To obtain an optimal dimensioning, it may be expedient to support the road section 7 or 7' in the uppermost position, that is, in the so-called "coupling position" directly by the ramp wedge 18 rather than by the follower pin 22.

If, conversely, the road section 7 or 7' is pivoted upwardly from its lowermost position in which it lies on the lower chord 2, then the ramp wedge 18 is pivoted upwardly by means of the guide track 21 with the intermediary of the follower pin 22.

Figure 4:
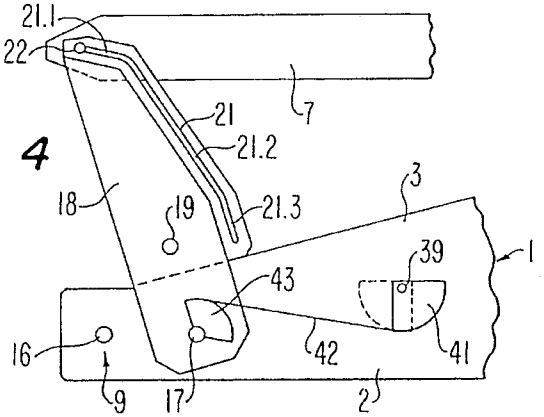
FIG. 4 is a view similar to FIG. 3, illustrating the construction in a position for coupling with another bridge section.

In the position of the ramp wedge 18 and the road section 7 shown in FIG. 4, the bridge sections A are coupled to form a bridge. The bridge B2 shown in FIG. 2 is formed of the two bridge sections A1 and A2.

Figure 10:
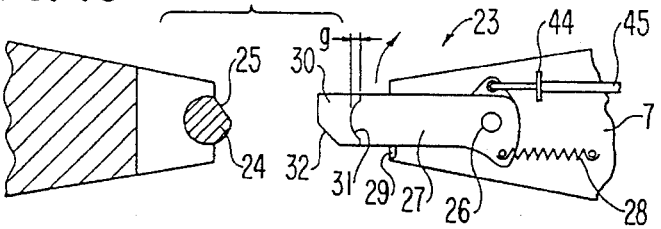
FIG. 10 is a side elevational view of the coupling mechanism of movable road sections prior to coupling.
Figure 11:
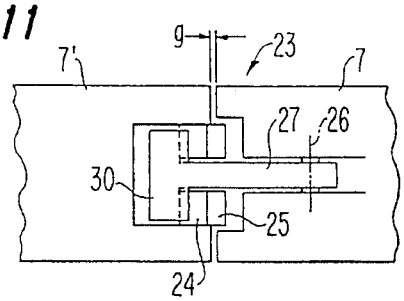
FIG. 11 is a top plan view of the construction shown in FIG. 10, illustrated in a coupled state.
Figure 12:
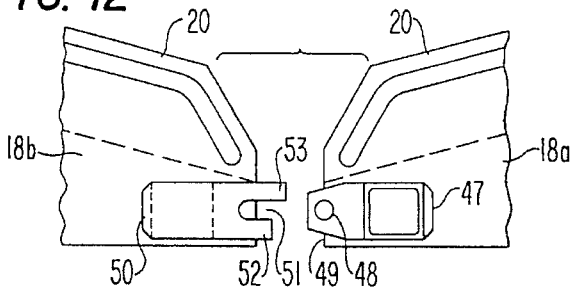
FIG. 12 is a sectional view taken along line XII—XII of FIG. 13 of ramp tips of an embodiment of two bridge sections to be coupled to one another, depicted during motion toward one another.
Figure 13:
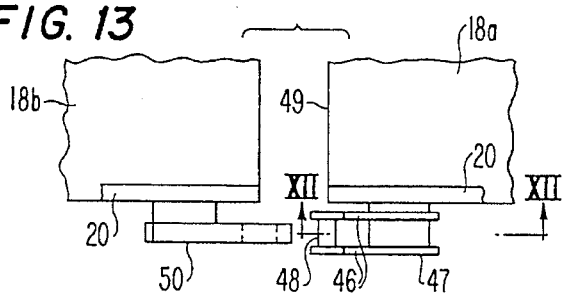
FIG. 13 is a top plan view of the construction shown in FIG. 12.
Figure 14:
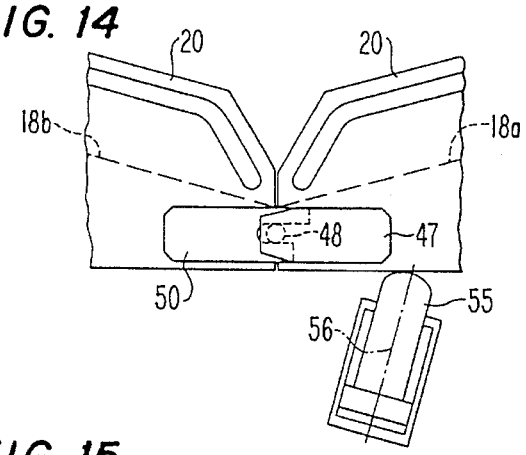
FIG. 14 is a side elevational view of the ramp tips shown in FIG. 12, illustrated after contacting.
Figure 15:
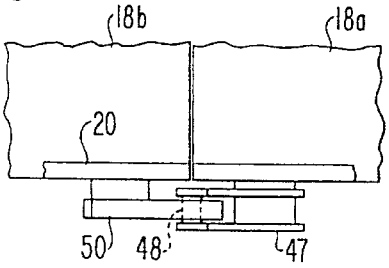
FIG. 15 is a top plan view of the ramp tips after contacting.

Turning to FIGS. 10 and 11, for effecting a coupling of the bridge sections, the pivotal road sections 7, 7' have an upper chord coupling 23 which is structured as follows: a road section, for example, the road section 7' of one bridge section A1 is provided with a pin 24 (which may be a two-part component) having an oblique sliding face 25. The associated road section 7 of the other bridge section A2 has a T-shaped hook 27 pivotal about a horizontal axis 26. The hook 27 is urged against an abutment 29 by a tension spring 28 and is maintained elastically in its basic position in which it is ready to carry out the coupling operation.

The head portion 30 of the T-shaped hook 27 has a concave inner face 31 corresponding to the shape of the pin 24 and a lower sliding face 32 corresponding to the sliding face 25 of the pin 24. The inner face 31 has, based on its concave construction, a depth g, as viewed in the longitudinal direction of the hook 27 or the road section 7.

Figure 8:
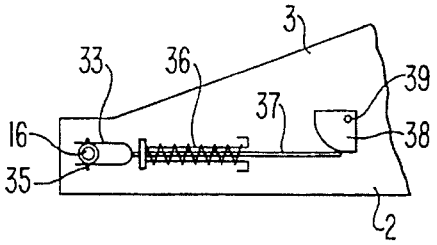
FIG. 8 is a sectional view taken along line VIII—VIII of FIG. 9, showing a lower chord coupling at one end of the bridge section.

Also referring to FIGS. 8 and 9, the pins 16 associated with the coupling arrangement 9 of the lower chord 2 are in engagement with a guiding slide 33 at an end portion of the base body 1 formed by the side plates 12 of the lower chord 2. The guiding slide 33 is, as viewed laterally, of U-shaped configuration in which the plane of symmetry of the U shape extends in the longitudinal direction of the lower chord 2 and the inner distance between the upper and the lower leg of the guiding slide 33 generally corresponds to the diameter of the pin 16. Both legs of the "U" have control slots 34 arranged in a V shape, as viewed from the top, into which extend from above and from below tabs 35 affixed to the pins 16.

The guiding slide 33 is pressed by compression spring 36 engaging the lower chord 2 of the base body 1, to the end of the base body or, more precisely, against its lower chord 2. In this position, as shown in FIG. 9, the points of the control groove 34 that are in engagement with the pin 35 have a large distance from one another. In this position, the pins 16, guided by the tabs 35, are in their outer position ready for the coupling operation. The guiding slide 33 may be pulled against the force of the spring 36 by a tension element 37 in the direction of the middle of the lower chord 2, that is, towards the middle of the base body 1 of the bridge section. In this position of the guiding slide 33, the points of the control slots 34 in engagement with the pin 35 are at a small distance from one another. In this position of the guiding slide 33 the pins 16 are in their innermost, non-coupling position.

The tension element 37 is secured at a location on the circumference of a carrier or coupling disk 38 shaped as a circular sector. The coupling disk 38 is secured to a coupling shaft 39 which may be actuated from the exterior, by means of a bridge deploying device (illustrated only by its part 40) of a laying vehicle by means of a crank 39' secured to the coupling shaft 39. The part 40 may be a vertically movable transverse coupling member.

Reverting to FIGS. 3 and 4, to the coupling shaft 39 there is secured a further coupling or carrier disk 41 which is connected by means of a tension element 42 with a carrier disk 43 secured to the shaft 17. The tension element 42 is arranged "crosswise" relative to an imaginary connecting line or plane of the shafts 17 and 39, that is, upon a rotation of the coupling shaft 39 in the sense that the pins 16 move into the non-coupling position, the ramp wedges 18 are, by means of the tension element 42, the carrier disk 43 and the shaft 17 pivoted upwardly at least to the location where the tips of the ramp wedge 18 lie above the shaft 17 so that a further upward motion of the ramp wedges 18 is possible upon moving the bridge elements A1, A2.

Upon moving the bridge sections A1, A2 toward one another while the road sections 7 and 7' are in their upper position, the hook 27 slides with its slide face 32 over the corresponding slide face 25 of the pin 24 into the coupling position and is maintained therein by the tension spring 28.

For disengaging the upper chord coupling 23, first the lower chord coupling (pin 16) is released and thereafter the two road sections 7, 7', by virtue of moving to one another the bridge sections A1, A2, approach one another at least by the distance g, so that the head portion 30 of the T-shaped hook 27 may be lifted above the pin 25 by lifting the base body 1 of the bridge section A2. Thereafter, the two bridge sections may be moved away from one another.

In the description which follows, the joining (coupling) of two bridge sections will be set forth once more.

The bridge sections are, with lowered road sections 7, 7' and correspondingly flat-lying ramp wedges 18 moved to one another at identical height levels until the tips of the ramp wedges 18 touch one another. The pins 16 of the lower chord couplings are at this time in the locking state. With the aid of the coupling traverse 40 the crank 39' of the coupling shaft 39 and thus the coupling disks 38 and 41 are rotated in the sense that on the one hand the guiding slide 33 is withdrawn and thus the pins 16 are pulled into their position in which they release the receivers 13 defined by the side plates 12 and, simultaneously the ramp wedges 18 are raised beyond the height level of the shaft 17. It suffices when the upward pivotal motion of the ramp wedges 18 by the coupling traverse 40 is effected up to this position.

A further upward pivotal motion of the ramp wedges 18 (and a lifting of the road sections 7, 7') occurs because the mutually contacting bridge sections A1, A2 are pressed further towards one another until the ramp wedges 18 are fully in an upstanding position and the road sections 7, 7' abut one another in their highest position. During this occurrence, the spring-biased hook 27 of the one road section 7 automatically snaps behind the pin 24 of the other road section 7'. By lowering the coupling traverse 40 the crank 39' is released and the pins 16 are, by means of the compression spring 36, pressed into their locking position. In this manner, both the upper chord and the lower chord of the bridge sections are locked.

For releasing the bridge sections from one another, first the lower chord coupling including the pins 16 is released. By lifting that portion of the bridge section A2 which is situated remote from the hook 27, the adjoining road sections 7, 7' are moved to one another by a distance g. By lifting the end of the bridge section A2 with the hook 27, the upper chord coupling too, is released and the bridge sections A1, A2 may be separated from one another. By lowering the crank 39' the pins 16 are moved again into their locking position and the road sections 7, 7' as well as the ramp wedges 18 are moved in a controlled manner from the "road or coupling position" into the "ramp or drive-on position".

Referring once again to FIG. 10, as a departure from the above-described uncoupling operation, the hook 27 of the upper chord coupling may be actuated individually, for example, by means of a bowden cable 45 attached at 44 to the respective road section 7, whereby a lifting of the entire bridge section is avoided. The bowden cable may be attached at its other end preferably to the lower chord region 2 of the bridge section and its inner wire may be actuated by the coupling shaft 39 in a manner described earlier for the tensioning element 37.

Turning to FIGS. 12, 13, 14 and 15, according to a modified embodiment the ramp wedges **18*a* of the bridge sections have at one side (for example, at the inner side) next to the guiding profile 20 a holder 47 which is formed of two plates 46 and has a pin 48 whose axis lies approximately in a vertical plane (or at least is oriented parallel thereto) containing the edge 49 of the tip of the ramp wedge 18*a***.

At the respective same sides the ramp wedges **18*b* have a holder 50 provided with an opening 51 constituting a guide groove extending parallel to the bottom of the ramp wedges 18*a* and 18*b* and parallel to the relative motion of the two bridge sections. The end 52 of the holder 50 underneath the opening 51 is shorter than the end 53 situated above the opening 51**.

Figure 7:
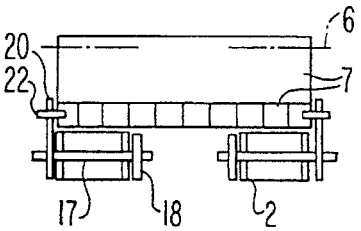
FIG. 7 is a sectional view taken along line VII—VII of FIG. 6.

In case two bridge sections of the embodiment of FIGS. 12–15 move towards one another on a bridge-deploying (laying) device by means of a mechanism known by itself (for example, as disclosed in FIGS. 7 and 10 of European Published Application 256 446 which is incorporated herein by reference), the pin 48 of the one ramp wedge **18*a* enters into the opening 51 of the holder 50 of the other ramp wedge 18*b*. When the edges 49 of the ramp wedges 18*a*, 18*b* are at least approximately in a contacting position, the horizontal relative motion is discontinued. This embodiment dispenses with a coupling between the ramp wedges 18 and the coupling shaft 39 by means of carrier disks 41 and 43 as described in connection with the embodiment of FIGS. 3 and 4. By actuating the coupling traverse 40 (see FIG. 9), the pins 16 are, in a manner described earlier, withdrawn into the releasing position and a plunger 55 (FIG. 14) is lifted which is situated underneath the ramp wedge 18*a*. The plunger 55 constitutes the end of the piston rod of a holder piston assembly which is mounted on the laying vehicle represented in FIG. 9 by the coupling traverse 40**. It is noted that the laying vehicle may be of the type and construction disclosed in European Published Application 256 446.

Figure 6:
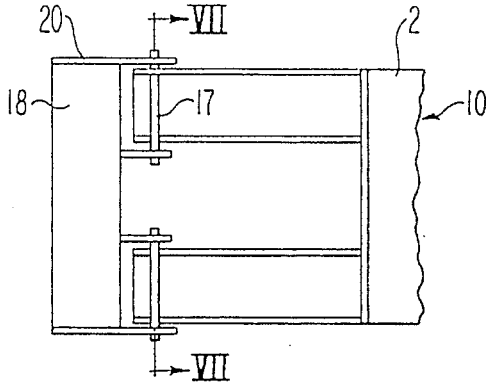
FIG. 6 is a top plan view of the construction illustrated in FIG. 3.

Upon lifting of the plunger 55 the ramp wedge **18*a* is directly raised. At the same time, the ramp wedge 18*b* is also lifted, in an indirect manner, by means of the pin 48 and the upper end 53 of the holder 50. Such lifting operation proceeds until the tip edge 49 of the ramp wedges 18*a*, 18*b* are situated above the rotary axes of the shafts 17 (FIGS. 4 and 6). Upon reaching such a position, the motion of the plunger 55 is discontinued after a relatively short stroke and is, at a given time, withdrawn and the drive of the laying device is again actuated for at least one bridge section such that the bridge sections are further moved towards one another. During this occurrence the pin 48 slides off the shorter end 52 of the holder 50 while the longer upper end 53 still performs a supporting function. The mutual support of the upwardly inclined ramp wedges 18*a*, 18*b* occurs now by means of the tip edges 49 as a result of a further horizontal motion of the bridge base bodies 1** towards one another.

During support by the plunger 55, the ramp wedge **18*a* assumes different inclined positions. This circumstance is taken into account in the arrangement of the plunger 55 by providing that its axis (that is, its direction of motion) 56 is inclined to the vertical at an angle which corresponds to approximately one half the angle of the base face of the ramp wedge 18*a* relative to the horizontal at the end of the stroke of the plunger 55. Further, the supporting surface of the plunger 55 is of convex configuration to ensure that an edge pressure in the various positions of the ramp wedge 18***a* is avoided.

It will be understood that the above description of the present invention is susceptible to various modifications, changes and adaptations, and the same are intended to be comprehended within the meaning and range of equivalents of the appended claims.

What is claimed is:

1. A deployable bridge having at least one bridge section; said bridge section comprising (a) a base body having a length and opposite first and second ends; said base body having a height decreasing along the length at least towards one of said first and second ends;

(b) a road section having a length and opposite first and second ends; said first end of said road section being articulated to said base body for pivotal movement about a horizontal pivot axis oriented transversely to said length of said base body; said pivot axis being disposed at a location spaced from either end of said base body; said length of said base body and said length of said road section being generally coextensive; said road section having a first pivotal position in which said road section lies lengthwise on said base body and said second end of said road section is generally adjacent said first end of said base body; said road section having a second pivotal position in which said road section is in a raised state relative to said first pivotal position;

(c) a pivot shaft mounted on said base body at a location spaced from said first end of said base body; said pivot shaft having a horizontal pivot axis oriented transversely to said length of said base body; said pivot axis of said pivot shaft being disposed at a location spaced from said first end of said base body;

(d) a support member adjoining said first end of said base body; said support member having opposite first and second ends; said support member being articulated at said first end thereof to said base body by said pivot shaft for pivotal movement about said pivot axis of said pivot shaft; said support member having a first pivotal position in which said support member is in a flat-lying state; in said flat-lying state said second end of said support member projecting beyond said second end of said road section in a direction away from a location situated at midlength of said bridge section; said support member having a second pivotal position in which said support member is in a raised position relative to the first position thereof; and (e) coupling means for pivotally connecting said support member to said road section such that when said road section is in its said first position, said support member is in its said first position and said second end of said road section is supported on said support member.

2. The deployable bridge as defined in claim 1, wherein said pivot axis of said pivot shaft is situated at a distance from said second end of said road section measured in a direction toward a location situated at midlength of said bridge section.

3. The deployable bridge as defined in claim 1, further comprising locking means for immobilizing said support member with respect to said base body.

4. The deployable bridge as defined in claim 1, wherein said support member is formed as a wedge-shaped ramp having an upper edge tapering in a direction away from said road section in said first position of said support member.

5. The deployable bridge as defined in claim 4, wherein said coupling means comprises a guide profile secured to an upper zone of said support member as viewed in said first position thereof and a follower member affixed to said road section and being in engagement with said guide profile; said upper edge of said guide profile forming a road surface; said guide profile being situated above said guide surface.

6. The deployable bridge as defined in claim 1, further comprising locking means for locking together said support member and said base body to form a rigid unit in said first position of said support member; in combination with actuating means for placing said locking means into a locking state and into a releasing state.

7. The combination as defined in claim 6, wherein said locking means comprises an opening provided in said base body and a locking pin coupled to said actuating means for advancing said locking pin into and retracting said locking pin from said opening by said actuating means in said first position of said support member.

8. The combination as defined in claim 6, wherein said actuating means comprises a crank movable by an externally applicable force.

9. The combination as defined in claim 6, wherein said actuating means includes means for pivoting said support member from its said first position into its said second position as said actuating means places said locking means into the releasing state.

10. The combination as defined in claim 6, wherein said actuating means includes an actuating member connectable to said locking means.

11. The combination as defined in claim 10, further comprising a lifting device for lifting said support member from its said first position toward its said second position.

12. The combination as defined in claim 11, wherein said lifting device comprises a hydraulic cylinder and a plunger movable by said hydraulic cylinder; said plunger having an outer face adapted to engage a surface portion of said support member.

13. The combination as defined in claim 12, wherein said lifting device has a longitudinal axis oriented obliquely during lifting operation of the lifting device.

14. The deployable bridge as defined in claim 1, wherein said coupling means comprises a guide profile secured to an upper zone of said support member as viewed in said first position thereof.

15. The deployable bridge as defined in claim 14, wherein said guide profile has a generally rising slope from said second end of said support member as viewed in said first position of said support member.

16. The deployable bridge as defined in claim 14, wherein said guide profile has consecutive first and second length portions extending in a direction away from said second end of said support member; said first length portion being shorter than said second length portion and having a greater rising slope than a rising slope of said second length portion as viewed in said first position of said support member.

17. The deployable bridge as defined in claim 16, said guide profile further comprising a third length portion adjoining said second length portion and being arranged adjacent said pivot shaft; said third length portion having a substantially horizontal orientation as viewed in said first position of said support member.

18. The deployable bridge as defined in claim 14, wherein said coupling means further comprises a follower member affixed to said road section and being in engagement with said guide profile; said road section being supported by said guide profile through said follower member.

19. The deployable bridge as defined in claim 18, wherein said guide profile includes an abutment for limiting a displacement of said follower member relative to said guide profile; said abutment being situated at said second end of said support member.

20. The deployable bridge as defined in claim 18, wherein said guide profile comprises a guide groove.

21. The deployable bridge as defined in claim 20, wherein said follower member comprises a follower pin extending into said guide groove.

22. The deployable bridge as defined in claim 20, wherein said follower member comprises a follower roller received in said guide groove.

23. A deployable bridge having at least two bridge sections; each bridge section comprising (a) a base body having a length and opposite first and second ends; said base body having a height decreasing along the length at least towards one of said first and second ends;

(b) a road section having a length and opposite first and second ends; said first end of said road section being articulated to said base body for pivotal movement about a horizontal pivot axis oriented transversely to said length of said base body; said pivot axis being disposed at a location spaced from either end of said base body; said length of said base body and said length of said road section being generally coextensive; said road section having a first pivotal position in which said road section lies lengthwise on said base body and said second end of said road section is generally adjacent said first end of said base body; said road section having a second pivotal position in which said road section is in a raised state relative to said first pivotal position;

(c) a pivot shaft mounted on said base body at a location spaced from said first end of said base body; said pivot shaft having a horizontal pivot axis oriented transversely to said length of said base body; said pivot axis of said pivot shaft being disposed at a location spaced from said first end of said base body;

(d) a support member adjoining said first end of said base body; said support member having opposite first and second ends; said support member being articulated at said first end thereof to said base body by said pivot shaft for pivotal movement about said pivot axis of said pivot shaft; said support member having a first pivotal position in which said support member is in a flat-lying state; in said flat-lying state said second end of said support member projecting beyond said second end of said road section in a direction away from a location situated at midlength of said bridge section; said support member having a second pivotal position in which said support member is in a raised position relative to the first position thereof;

(e) first coupling means for pivotally connecting said support member to said road section such that when said road section is in its said first position, said support member is in its said first position and said second end of said road section is supported on said support member; and (f) second coupling means for coupling to one another respective second ends of two said support members belonging to two separate, end-to-end disposed bridge sections, whereby adjoining two support members are in an interconnected state in the second position of the two adjoining support members.

24. The deployable bridge as defined in claim 23, wherein said second coupling means includes cooperating coupling elements mounted laterally on respective said support members.

25. The deployable bridge as defined in claim 24, wherein one of said coupling elements is mounted on the support member of a first of said bridge sections and includes a carrier element, and wherein another of said coupling elements is mounted on the support member of a second of said bridge sections and includes means for defining a recess for receiving said carrier element of said one coupling element.

26. A deployable bridge having at least two bridge sections; each bridge section comprising (a) a base body having a length and opposite first and second ends; said base body having a height decreasing along the length at least towards one of said first and second ends;

(b) a road section having a length and opposite first and second ends; said first end of said road section being articulated to said base body for pivotal movement about a horizontal pivot axis oriented transversely to said length of said base body; said pivot axis being disposed at a location spaced from either end of said base body; said length of said base body and said length of said road section being generally coextensive; said road section having a first pivotal position in which said road section lies lengthwise on said base body and said second end of said road section is generally adjacent said first end of said base body; said road section having a second pivotal position in which said road section is in a raised state relative to said first pivotal position;

(c) a pivot shaft mounted on said base body at a location spaced from said first end of said base body; said pivot shaft having a horizontal pivot axis oriented transversely to said length of said base body; said pivot axis of said pivot shaft being disposed at a location spaced from said first end of said base body;

(d) a support member adjoining said first end of said base body; said support member having opposite first and second ends; said support member being articulated at said first end thereof to said base body by said pivot shaft for pivotal movement about said pivot axis of said pivot shaft; said support member having a first pivotal position in which said support member is in a flat-lying state; in said flat-lying state said second end of said support member projecting beyond said second end of said road section in a direction away from a location situated at midlength of said bridge section; said support member having a second pivotal position in which said support member is in a raised position relative to the first position thereof;

(e) first coupling means for pivotally connecting said support member to said road section such that when said road section is in its said first position, said support member is in its said first position and said second end of said road section is supported on said support member; and (f) second coupling means for coupling to one another respective second ends of two said road sections belonging to two separate, end-to-end disposed bridge sections, whereby adjoining two road sections are in an interconnected state in the second position of the two adjoining road sections.

27. The deployable bridge as defined in claim 26, wherein said second coupling means includes cooperating hook and pin components.

* * * * *